US012317971B2

(12) United States Patent
Parris

(10) Patent No.: US 12,317,971 B2
(45) Date of Patent: Jun. 3, 2025

(54) EXPANDING SURFACE JEWELRY DEVICE

(71) Applicant: Wayne Parris, Grand Haven, MI (US)

(72) Inventor: Wayne Parris, Grand Haven, MI (US)

( * ) Notice: Subject to any disclaimer, the term of this patent is extended or adjusted under 35 U.S.C. 154(b) by 0 days.

(21) Appl. No.: 17/832,163

(22) Filed: Jun. 3, 2022

(65) Prior Publication Data

US 2022/0386748 A1 Dec. 8, 2022

Related U.S. Application Data

(60) Provisional application No. 63/197,286, filed on Jun. 4, 2021.

(51) Int. Cl.
*A44C 25/00* (2006.01)

(52) U.S. Cl.
CPC ..... *A44C 25/001* (2013.01)

(58) Field of Classification Search
CPC .... A44C 25/001; A44C 25/002; A44C 25/004
See application file for complete search history.

(56) References Cited

U.S. PATENT DOCUMENTS 144,153 A 10/1873 Smith
298,540 A * 5/1884 Allen ..... A44C 25/001 63/23
316,118 A 4/1885 Cooke
569,100 A * 10/1896 Gunther ..... A44C 25/001 63/23
944,744 A 12/1909 Pine
1,032,257 A * 7/1912 Walrow ..... A44C 25/001 428/3
2,176,253 A 10/1939 Fogarty
2,501,917 A * 3/1950 Reilly ..... A44C 25/002 63/18
D167,387 S 8/1952 Blecher
2,863,307 A * 12/1958 Donle ..... A44C 25/004 63/19
3,178,842 A 4/1965 Zimmerman
3,180,042 A 4/1965 Destal
3,381,495 A * 5/1968 Emerson ..... A44C 15/004 428/3

(Continued)

FOREIGN PATENT DOCUMENTS

DE 20200801398 2/2009
FR 1425843 1/1966

(Continued)

OTHER PUBLICATIONS

European Patent Office; PCT International Search Report, issued in connection to PCT/US2022/032221; Oct. 14, 2022; 5 pages; Europe.

(Continued)

*Primary Examiner* — Emily M Morgan
(74) *Attorney, Agent, or Firm* — Sidney Persley

(57) ABSTRACT

A jewelry device constructed of facially opposing plate members for capturing and displaying information or images on the surface of the plate members, when the device is in a closed viewing position or when manipulated to be in an open viewing position, and containing expandable surfaces, integral to the construction of the device, and generated without the use of parts external to device's construction.

5 Claims, 10 Drawing Sheets

(56) References Cited

U.S. PATENT DOCUMENTS

| | | | | | |
|---|---|---|---|---|---|
| D217,625 | S | | 5/1970 | Lacy | |
| 3,968,661 | A | * | 7/1976 | Williams | A44C 25/001 63/31 |
| 4,034,573 | A | * | 7/1977 | Elkaim | A44C 3/007 428/3 |
| 4,197,665 | A | | 4/1980 | Siiter | |
| 4,741,434 | A | | 5/1988 | Liebman | |
| 4,882,915 | A | | 11/1989 | Porcaro | |
| D316,118 | S | | 4/1991 | Cole | |
| 5,383,343 | A | * | 1/1995 | Thach | A44C 25/001 70/456 R |
| 5,526,551 | A | | 6/1996 | Herman | |
| D380,979 | S | | 7/1997 | Perlmutter | |
| 5,842,365 | A | * | 12/1998 | Bordonaro | A45C 11/32 206/38.1 |
| 6,351,903 | B1 | | 3/2002 | Tuomi | |
| D618,130 | S | | 6/2010 | Polonye | |
| 8,955,356 | B1 | * | 2/2015 | Smith | A44C 25/007 63/900 |
| 9,844,247 | B2 | * | 12/2017 | Kelly | A44C 15/005 |
| D896,683 | S | | 9/2020 | Subrin | |
| 10,789,861 | B1 | | 9/2020 | Boddie | |
| D944,744 | S | | 3/2022 | Armacost et al. | |
| 2004/0129022 | A1 | * | 7/2004 | Chien | A44C 25/001 63/1.11 |
| 2007/0234757 | A1 | | 10/2007 | Sherman | |
| 2009/0293542 | A1 | | 12/2009 | Anderson | |
| 2010/0251769 | A1 | | 10/2010 | Samuels | |
| 2014/0209116 | A1 | | 7/2014 | Seibt | |

FOREIGN PATENT DOCUMENTS

| | | |
|---|---|---|
| FR | 2309174 | 11/1976 |
| FR | 2312987 | 12/1976 |
| KR | 101345128 | 12/2013 |
| KR | 102141436 | 8/2020 |
| WO | 2016/090119 | 6/2016 |
| WO | 2022/256693 | 8/2022 |

OTHER PUBLICATIONS

European Patent Office; PCT Written Opinion of the Inernational Searching Authority, issued in connection to PCT/US2022/032221; Oct. 14, 2022; 7 pages; Europe.

The International Bureau of WIPO; PCT International Preliminary Report on Patentability, issued in connection to PCT/US2022/032221; Nov. 21, 2023; 7 pages; Switzerland.

* cited by examiner

EXPANDING SURFACE JEWELRY DEVICE

BACKGROUND OF THE INVENTION

The present invention relates to a jewelry device constructed of facially opposing plate members having expandable surfaces for capturing and displaying images or information for viewing when the device is in a closed viewing position or when the device is manipulated to be in an open viewing position. The expandable surfaces are integral to the construction of the device and are generated without the use of parts external to the construction of the device.

The prior art describes several techniques and mechanisms for combining the plates of a jewelry device together, as a single unit to, for example, form a hanging pendant piece of jewelry. The primary mechanism for combining plates of a jewelry device typically relies on loops, clips or pins. For example, U.S. Pat. Nos. 3,178,842 and 3,180,042 describe locket jewelry devices that contain fold-up cases having two legs that are folded down on a pivot, to allow a wearer to read the information contained on the locket. German Patent DE 20200813898 describes a pendant having a stop, such as a bayonet and pin combination, where a projection pin on one element combines with the hollow cylinder of another element. The device uses a perpendicular loop on a plate to serve as a stop for the orientation of the plate, when combined with another plate. U.S. Design Patent No. 316118 employs a tubular shaped body that is screw threaded around its circumference. French Patent No. 1425843 describes a splitable jewelry device having two nested plates, requiring separate loops for hanging the device. French Patent No. 2312987 contains two discs that clip or bond together by way of a tenon on one of the discs, which allows the disc to fit into an aperture on the other disc. U.S. Design Patent 944,744 describes plates or disc having a plurality of pivotally connected tags and requires a separate loop for hanging the disc. U.S. Design Patent 217,625 describes a jewelry device with two pieces snapped together, requiring a pry bar to separate the two pieces. The device also requires a separate, and detached, loop for hanging the device. U.S. Pat. No. 4,034,573 describes an ornament having two members that are movable relative to one another by way of a loop or ring. U.S. Patent Application No. 20140209116 and U.S. Design Patents 380,979 and 167,387 relate to jewelry device assembly, each require the use of a stem or pin to connect the assembly. The prior art also describes forming pendants or other jewelry devices using magnets to connect the plates or disc of the device. For example, French Patent No. 2,309,174, Korean Patent Nos. 101345128 and 102141436, U.S. Pat. Nos. 4,197,665 and 8,955,356, and International Patent Application No. WO 2016/090119 A1, all describe the use of magnets to connect the plates or disc of the jewelry device and/or to maintain the position of plate or disc elements making up the device.

It is an object of the present invention to provide a jewelry device, constructed of facially opposing plate members, where, for example, no pins, loops, clips, or magnets are required to construct, configure, attach, secure or stabilize the device. A further object of the invention is to offer a jewelry device capable of providing expandable surfaces on the plate members for capturing and displaying images or information for viewing on the device.

SUMMARY OF THE INVENTION

The present invention relates to a jewelry device represented by disengageable, facially opposing, plate members and integral hanging loops, where no pins, loops, clips, or magnets are used or required to construct, configure, attach, secure or stabilize the component parts, or elements, of the device.

In a particular advantageous embodiment of the present invention, the jewelry device offers plate members with expandable surfaces for capturing and displaying images or information for viewing on the device, when the device is in a closed, or manipulated to be in an open, viewing position.

BRIEF DESCRIPTION OF THE DRAWINGS

A better understanding of the present invention can be obtained when following detailed description of the enclosed embodiments is considered in conjunction with the following drawings, in which.

DETAILED DESCRIPTION

The jewelry device of the present invention is comprised of facially opposing plate members that match up and conform to either the orientation, configuration, or shape of each other. The plate members can be constructed of metal, wood, plastic, or a composite material, provided that the plate members should not be constructed of any materials that would cause them to have a weight that would create discomfort, or a problem, for the wearer of the jewelry device. They may also be decorated, or designed, with decorative materials such as gems, pearls, stones, etc. and contain information or images on their surface, which are produced, for example, by engraving, embossing, texturizing, etching, laser cutting, or die punching the plate members. As for the orientation, configuration, or shape of the plate members, they are designed to be combinable, such as being stacked, or partially stacked, with one another.

Figure 1:
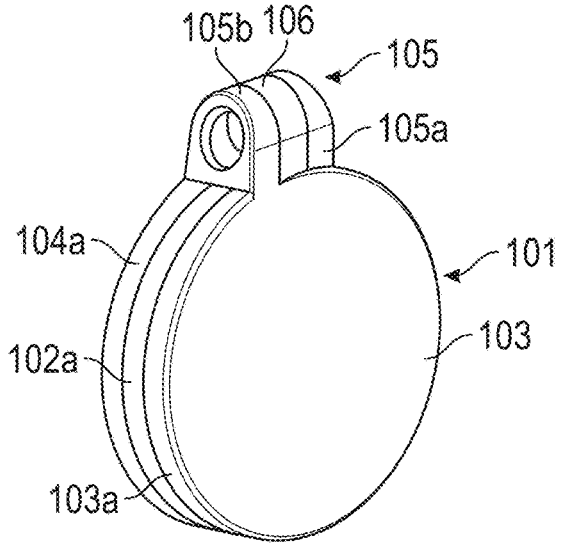
FIG. 1 is a perspective view of a round pendant in a closed viewing position illustrating: an integral hanging loop; and four exposed surfaces for capturing and displaying information or images.
Figure 7A:
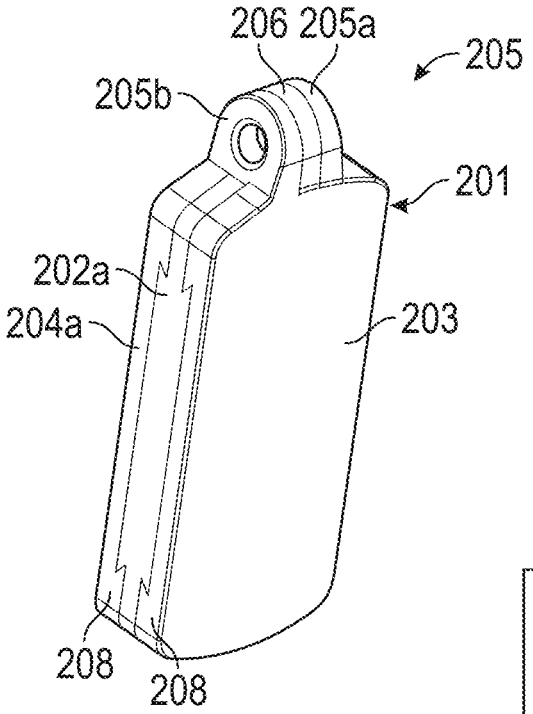
FIGS. 7A, 7B, and 7C, illustrate a perspective view of a rectangular pendant in a closed viewing position illustrating: an integral hanging loop; an integral hanging loop component, or portion, on each plate member; and a magnified distal end view of the central and back plate members of the pendant that shows an interlocking attachment mechanism for the plate members.
Figure 7B:
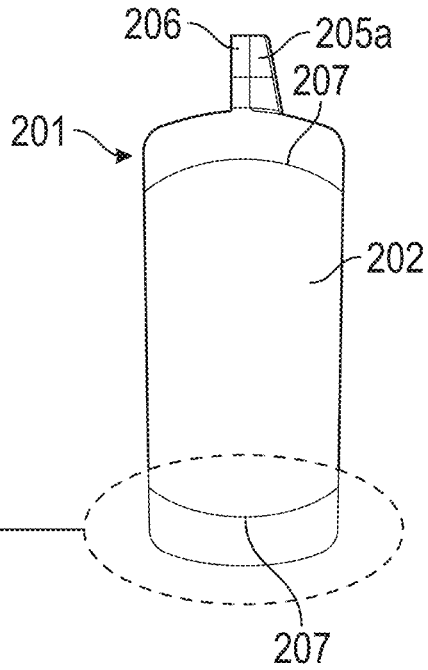
Figure 7C:
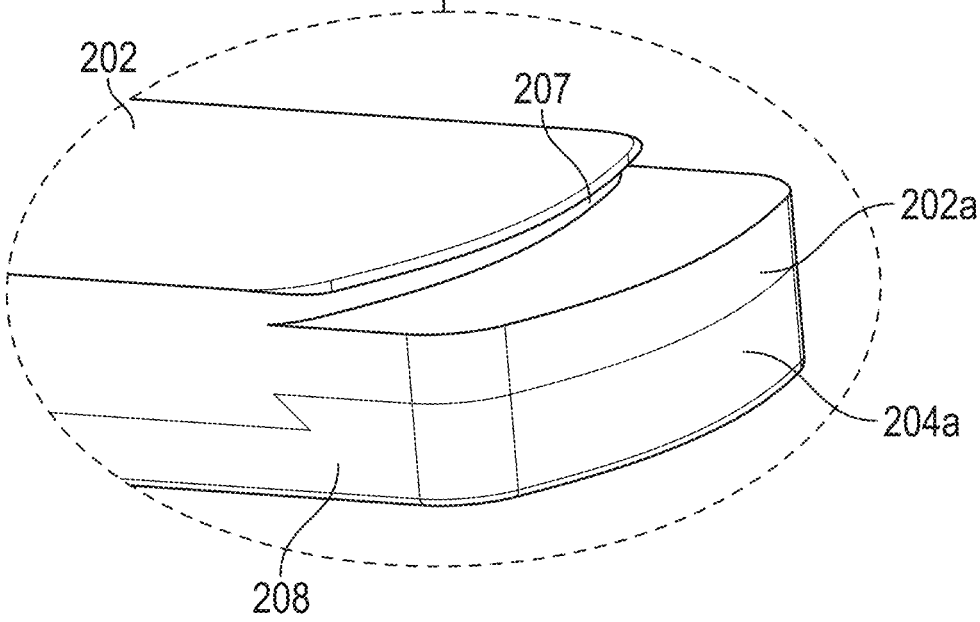
Figure 12A:
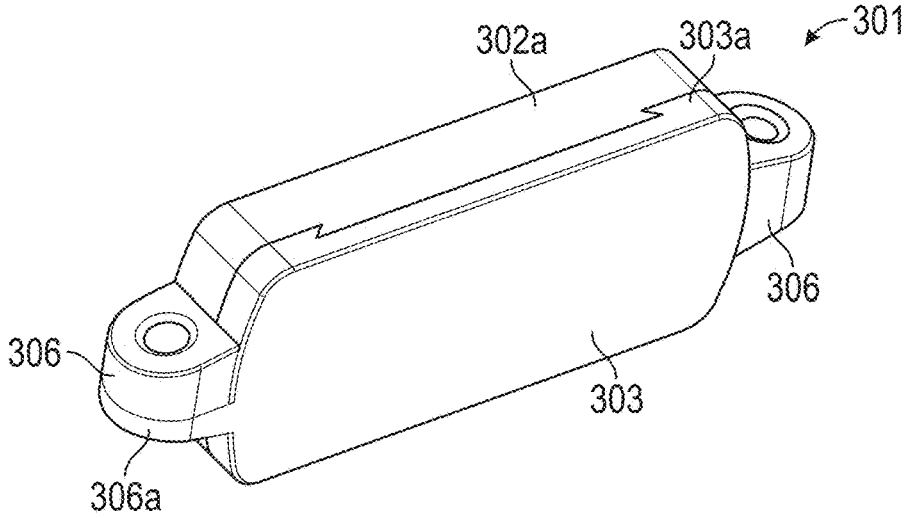
FIGS. 12A. 12B, and 12C, illustrate a perspective view of a rectangular locket having a recess in the central plate member, in the closed viewing position, with two integral loops, illustrating: the integral loop components, or portions, on each plate member; and an outer plate member rotated 90° from the central plate member, disengaged, and pulled away, from the central plate member to expose six additional surfaces, in addition to all the original surfaces shown in FIG. 12A-C, for capturing and displaying information or images.
Figure 12B:
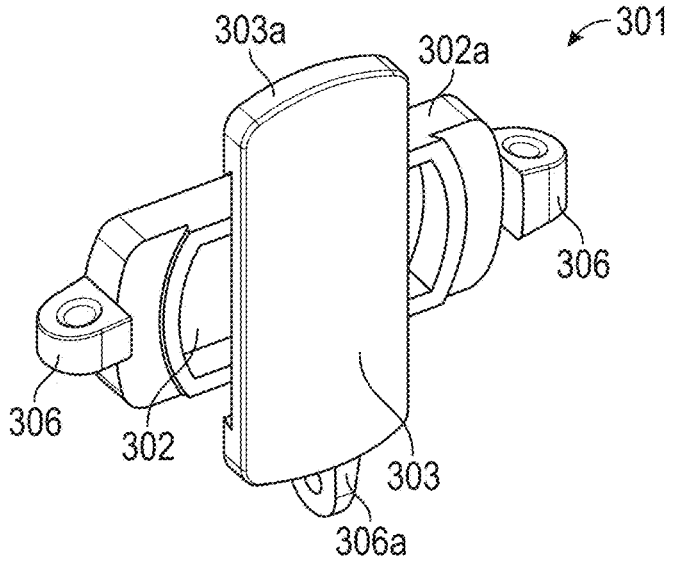
Figure 12C:
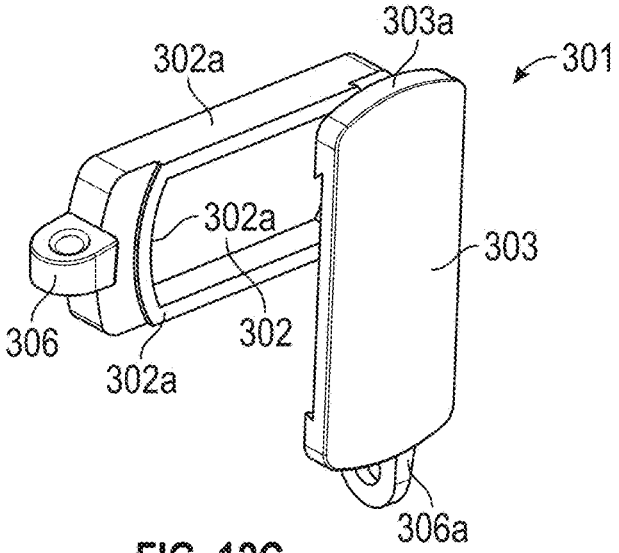

Although the jewelry device 101 in FIG. 1 is shown as a round shape, and the device 201 in FIG. 7A-C is shown as rectangular, the geometry of the device can be any shape, such as a circle, rectangle, square, heart, star, disc, etc. For example, FIG. 12A-C shows a device, rectangular in shape, where one plate member 302 is comprised of a recess, or cavity. Upon manipulating the device in FIG. 12A-C to be in an open viewing position, the cavity or recess is revealed. Subsequently, in the open viewing position, five additional surfaces on plate member 302 are exposed, and one additional surface, on the inside surface of front plate member 303, are produced for capturing and displaying information, data and images. The plate members can be of any size and thickness, with the caveat that the size and thickness of the plate members should not produce a jewelry device having a size so substantial that it creates discomfort, or a problem, for the wearer of the device. As shown in the preferred embodiment of FIG. 2, the diameter for a round central plate member 102 and round outer plate members 103 and 104 is preferably about 1.25 inches, while the plate member has a thickness that is preferably no more than about 0.25 inches. In the embodiment illustrated by FIG. 7A-C, the dimensions for the rectangular central plate member 202 and rectangular outer plate members 203 and 204 are preferably about 1.25 inches wide and about 1.25 inches long, while the thickness for the plate members is preferably no more than about 0.25 inches, and more preferably no more than about 0.046 inches.

Any number of facially opposing plate members can be used to construct the jewelry device. In a preferred embodiment of the invention, a central plate member is sandwiched between two outer plate members, and each plate member is comprised of one, or more, hanging loop components, or portions, that contribute to, and join to form, the integral hanging loop, or hanging loops, on the jewelry device.

Figure 5A:
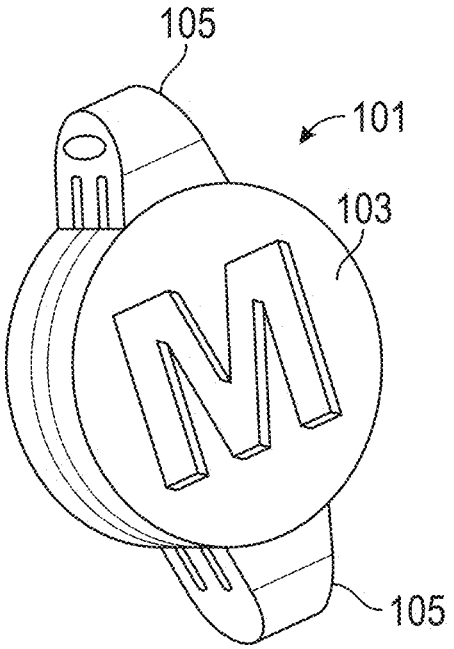
FIGS. 5A. 5B, and 5C illustrates a perspective view of a round locket in a closed viewing position, having an integral hanging loop, where the display on an outer plate member appears as the letter "M"; an outer plate member rotated 15° counter clockwise, disengaged, and pulled away, from the central plate member; and an outer plate member, rotated 15° counter clockwise, engaged with the central plate member and further rotated a full 180° counter clockwise, to be, again, engaged with the central plate member and result in the inversion of the display on the outer plate member to appear as the letter "W".
Figure 5B:
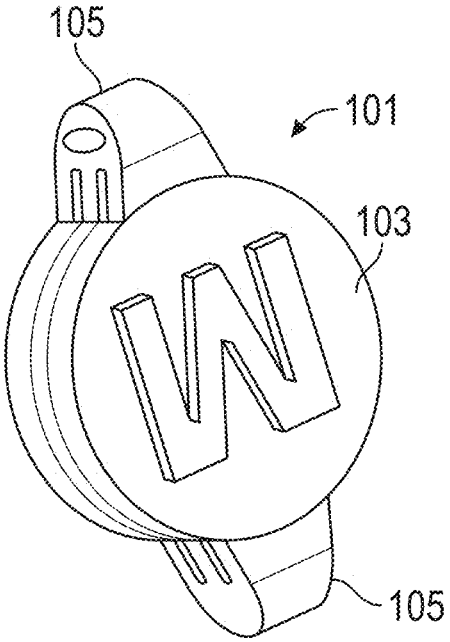
Figure 5C:
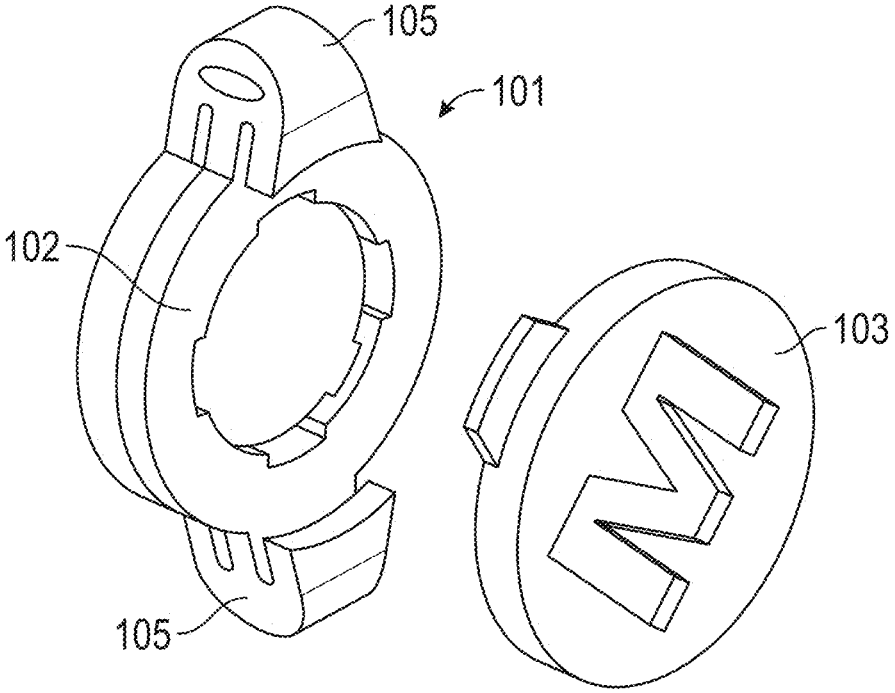
Figure 6A:
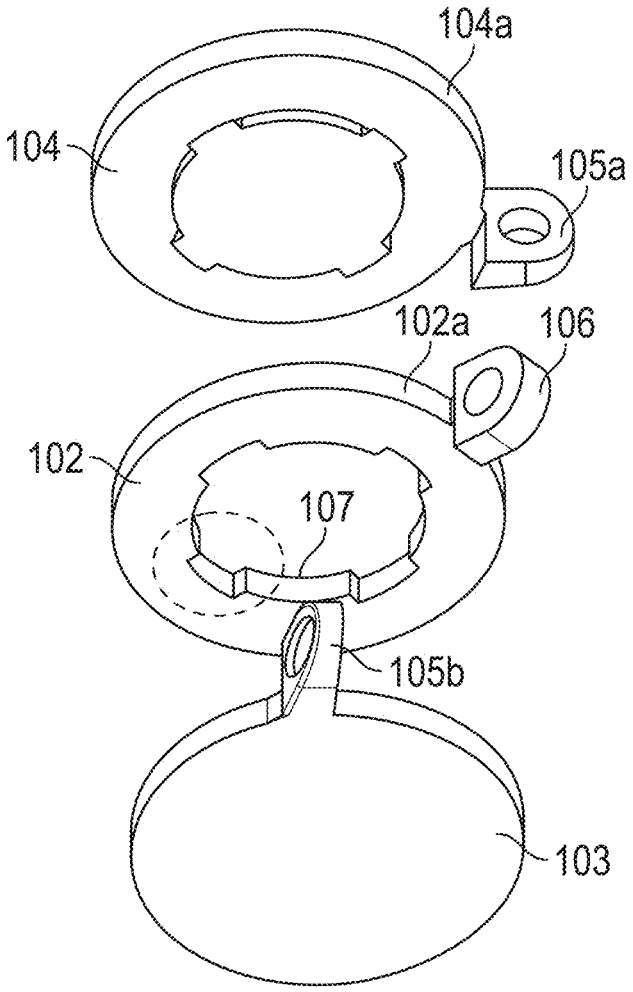
FIGS. 6A. 6B. 6C, and 6D, illustrate an exploded forward-facing view of a round pendant in an open viewing position illustrating: each facially opposing plate member; an integral hanging loop component, or portion, on each plate member; and an interlocking attachment mechanism for the plate members.
Figure 6B:
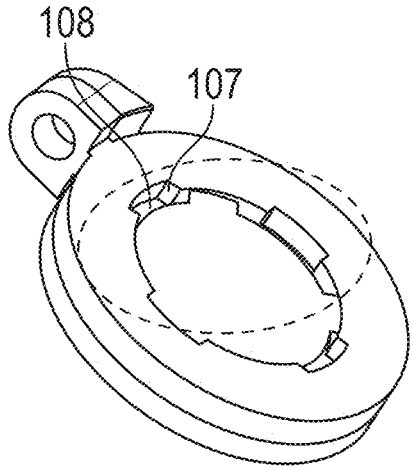
Figure 6C:
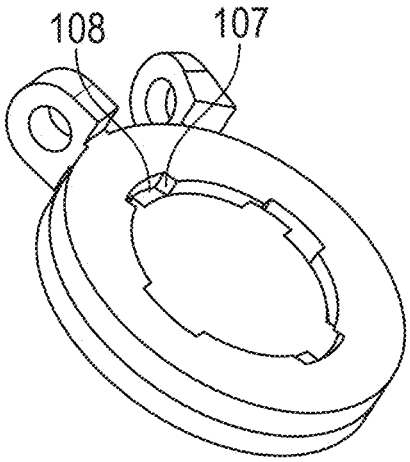
Figure 6D:
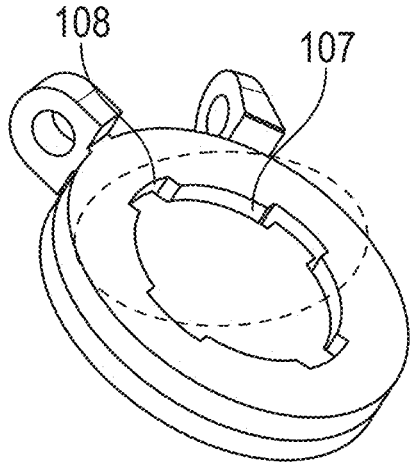

When worn by a user, either one of the flat surfaces of the outer plate members will face outward and be visible to the wearer of the jewelry device and others. The design or display on the surfaces of an outer plate members can easily be exchanged for another design, replaced by another outer plate member, or altered by rotating the outer plate members. FIG. 5A-C, for example, demonstrates a round locket 101, having two integral hanging loops 105 in a closed viewing position, where the display on the outer plate member 103 of the locket appears as the letter "M". The outer plate member 103 can be manipulated by being rotated 45° counterclockwise, with respect to the central plate member 102. The rotation disengages the outer plate member 103 from the central plate member 102 via the attachment mechanism. The outer plate member 103 can then be pulled away from the central plate member 102. Opon being disengaged from the central plate member 102, the outer plate member 103 can again engaged with the central plate member 102, and further rotated until rotated a full 180°, with respect to the central plate member 102. The rotation causes the outer plate member 103 to reengage with the central plate member 102 via the attachment mechanism. The 180° rotation of outer plate member 103, disengagement, and re-engagement of the outer plate member 103 to the central plate member 102, can result in the display appearing on the outer plate member 103 of the locket 101 subsequently becoming inverted and on the appear on the locket as the letter "W".

As illustrated in FIG. 1, the jewelry device of the present invention can be formed, forged, or constructed, as a round pendant device 101 that includes a central plate member 102, a first outer plate member 103, and a second outer plate member 104, where each outer plate member is mounted on opposite sides of the central plate member 102 to form the pendant device 101. The surfaces of the round pendant device, used for capturing and displaying information or images, include the front and back surfaces of the central plate member 102, the circumference of central plate member 102*a*, the front and back surfaces of the outer plate member 103, the circumference of first outer plate member 103*a*, the front and back surfaces of outer plate member 104, and the circumference of the second outer plate member 104*a*.

Figure 4A:
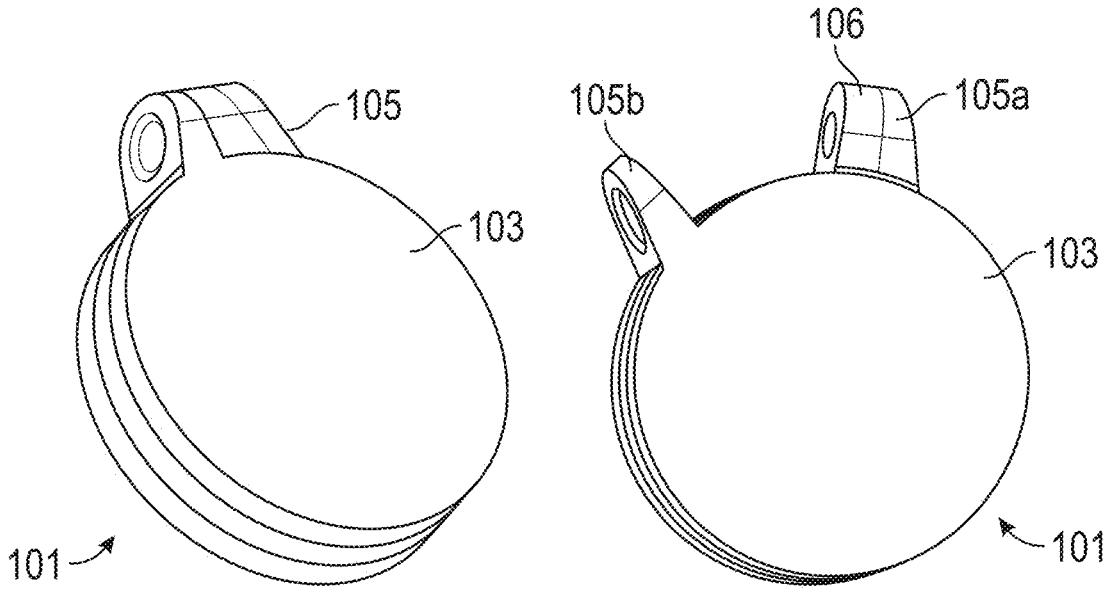
FIGS. 4A and 4B illustrates a perspective view of a round pendant in a closed viewing position, having an integral hanging loop illustrating: an integral hanging loop component, or portion, on each plate member; an interlocking attachment mechanism for the plate members; and an outer plate member rotated 15 counterclockwise, disengaged, and pulled away, from the central plate member to expose two additional surfaces, in addition to the six original surfaces in FIGS. 4A and 4B, for capturing and displaying information or images.
Figure 4B:
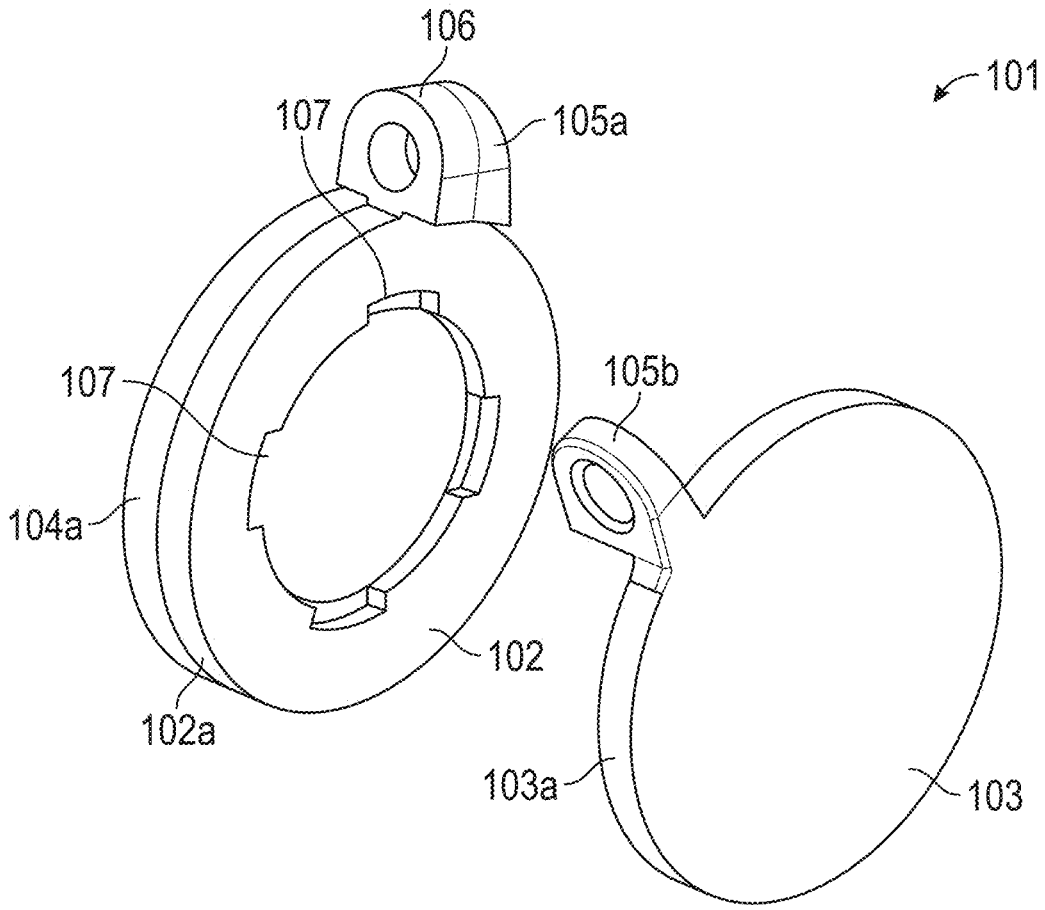

As illustrated in FIG. 4A-B, the round pendant device 101 contains an integral hanging loop 105, and as illustrated in FIG. 7A-C, the rectangular pendant device 201 contains an integral hanging loop 205. FIG. 12A-C embodies a rectangular pendant device 301 containing two integral hanging loops 306. The integral hanging loops allow the device to be connected to, or attached, for example, to a chain of a standard necklace, bracelet, another piece of jewelry, or to some other product that uses a chain or ring, such as a key chain.

Figure 2:
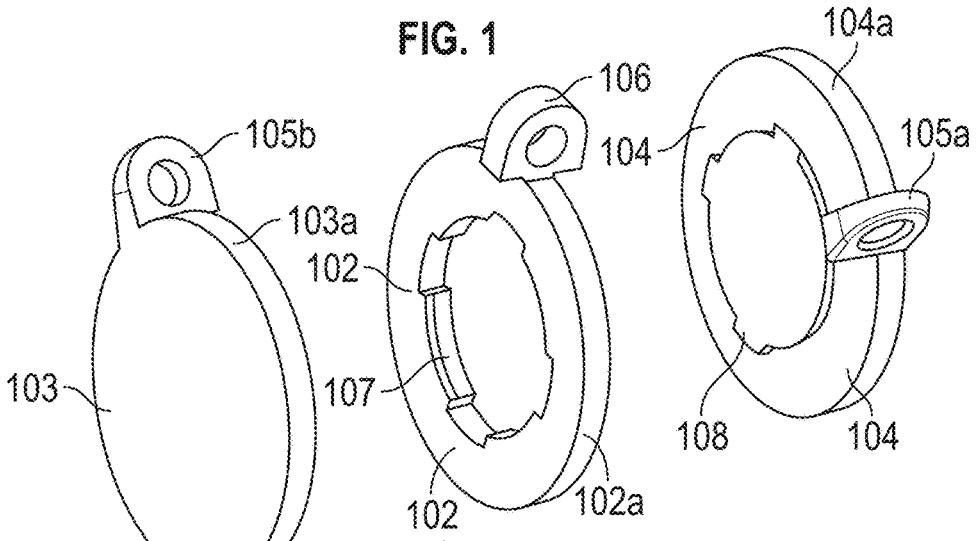
FIG. 2 is an exploded perspective view of the round pendant of FIG. 1 in an open viewing position, illustrating: various facially opposing plate members of the pendant; an integral hanging loop component, or portion, on each plate member; an interlocking attachment mechanism for the plate members; and outer plate members rotated 15° counterclockwise, disengaged, and pulled away, from the central plate member to expose six surfaces for capturing and displaying information or images.

FIG. 2 illustrates the hanging loop components, or portions, of the first and second outer plate members 105*b* and 105*a*, respectively, and the hanging loop component, or portion, of the central plate member 106. As one can see, they are integral to the construction of plate members 102, 103 and 104 and are positioned to be perpendicular to the primary flat surface of each plate member. The hanging loop components, or portions, are each individually employed for partially forming the integral hanging loop 105 for device 101 when they are aligned and come together.

Figure 3:
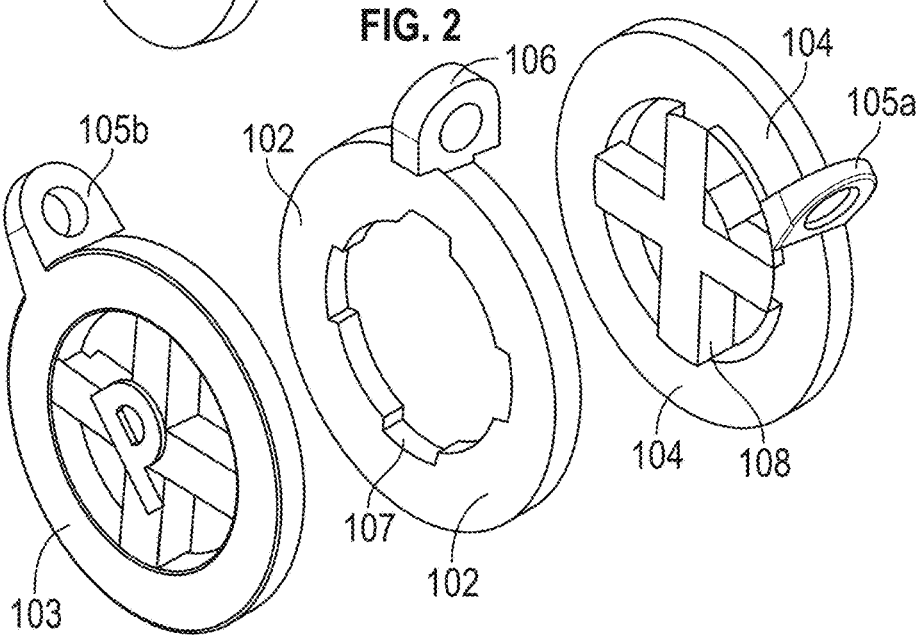
FIG. 3 is an exploded forward-facing view of the round pendant of FIG. 1 in an open viewing position illustrating: various plate members of the pendant; an integral hanging loop component, or portion, on each plate member; an interlocking attachment mechanism for the plate members; and outer plate members rotated 15° counterclockwise, disengaged, and pulled away, from the central plate member to expose the six surfaces displaying information or images.

The device can appear in a closed viewing position, such as in FIG. 1, or an open viewing position, such as in FIG. 2. When central plate member 102 is in its closed, protected, or semi-locked viewing position, the inner surfaces of the plate cannot be viewed. The only images and information which can be viewed or displayed are contained on the circumference of the central plate member 102*a*. FIG. 3 shows images or information captured and displayed on the surfaces, circumference, and inner circumference of plate members 102, 103 and 104 for the device 101.

In FIG. 3, the outer plate members 103 and 104 have been detached, or disengaged, and pulled away from the central plate member 102. In this state, the device 101 is in the open viewing position, which further exposes additional surfaces, in addition to all the original surfaces for capturing images or information.

As for the type of images or information that can be captured and displayed on the various surfaces for the plate members, e.g., surfaces 102, 102*a*, 102*b*, 103, 103*a*, 103*b*, 104, 104*a* and 104*b*, they can be, for example, personal and/or medical information pertaining to the wearer of the device. Typical of the images, or personal and medical information, which may be displayed on each plate member can, for example, be physical identification information such as name, address, occupation, social security number, date of birth, sex, and religion. The information can also be medical information such as special medical alert for particular pre-existing disease or conditions which might affect medical treatment, such as heart problems, diabetes, epilepsy, high blood pressure, asthma, hemophilia, drug allergies, or the like. Other items of medical history, and the results of a most recent checkup may also be reflected on a plate member. In addition, information on an insurance carrier, the private physician, and the person to be notified in the case of an emergency can be indicated on a plate member. When the device is connected to the collar of a pet, the information may include, for example, the pet owner's name, address and telephone number, the animal's name, species, color and markings, and the veterinarian's name, address and telephone number, pet's medical history, including vaccinations for rabies, distemper, hepatitis, and the like, the date of heartworm checks and fecal checks, the existence of any life threatening illnesses, the medications currently being taken by the pet, and any allergies to drugs or other substances may also be included. As for displaying an image on a plate member, it can be a personalized design, logo or art. The image design can be a separate piece which is connected permanently or selectively to the surface of the plate member or can be integrally formed as part of the plate member during manufacturing.

In one embodiment, the device 101 could have designs on the surfaces of the outer plate members, e.g., surfaces 103, 103*a*, 103*b*, 104, 104*a* and 104*b* in FIG. 3, that are matching halves and representing a single pendant or two halves. The design could also have a corresponding component on the inside surfaces of the central plate member 102. Therefore, each matching half may be reversible as the surface of the plate is displayed when worn as a pendant half or may be dividable to be worn by two people. Also, each matching half could be interchangeable, having different designs on the surface allowing a retailer to store many halves, but the customer can decide on which sides she/he would like to combine and purchase other matching halves to change the pendant's appearance. The pendant could also be worn with just one half or two halves that correspond well and look great when connected to each other, either symbolically or aesthetically. In this way, one can give one part of a heart shaped pendant to a friend. For example, this design would allow a woman to give one-half of her heart shaped pendant to a loved one, without compromising the beauty and integrity of a fully shaped heart pendant, and look great when connected to each other, either symbolically or aesthetically.

Figure 8A:
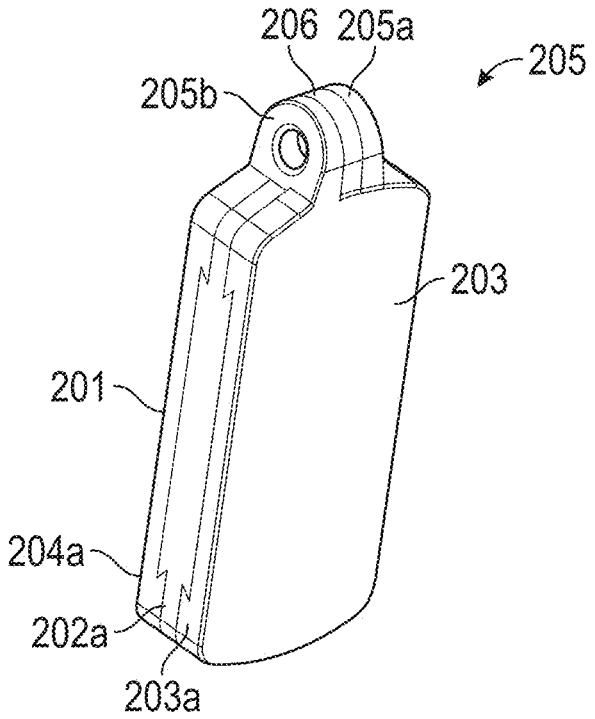
FIGS. 8A and 8B, illustrate a perspective view of a rectangular pendant in a closed viewing position illustrating: an integral hanging loop; an integral hanging loop component, or portion, on each plate member; an interlocking attachment mechanism for the plate members; and an outer plate member rotated 15° counterclockwise, disengaged, and pulled away, from the central plate member.
Figure 8B:
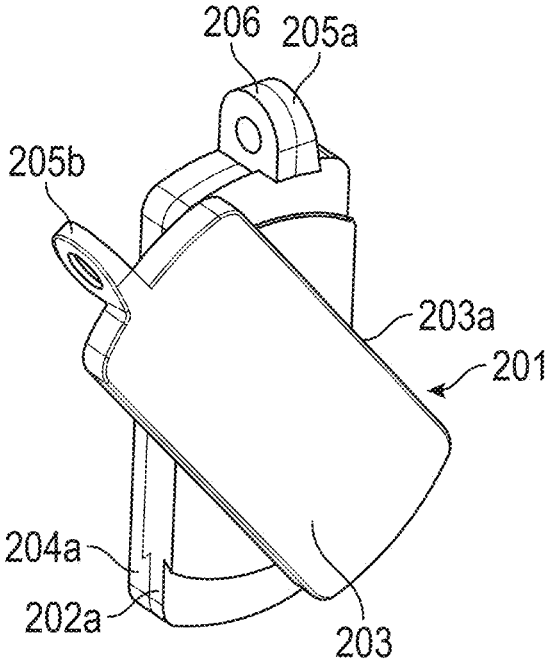
Figure 9A:
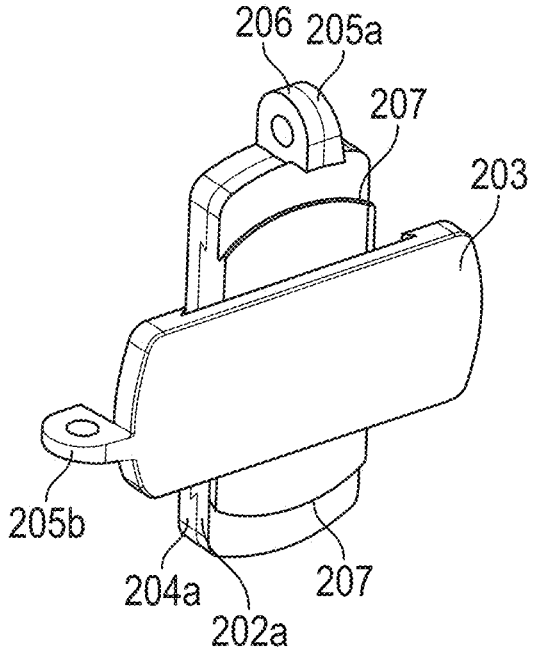
FIGS. 9A and 9B, illustrate, a perspective view of a rectangular pendant illustrating: an integral hanging loop; an integral hanging loop component, or portion, on each plate member; an interlocking attachment mechanism for the plate members; and an outer plate member rotated 90° counterclockwise, disengaged, and pulled away, from the central plate member to expose two additional surfaces, in addition to all the original surfaces shown in FIGS. 9A and 9B, for capturing and displaying information or images.
Figure 9B:
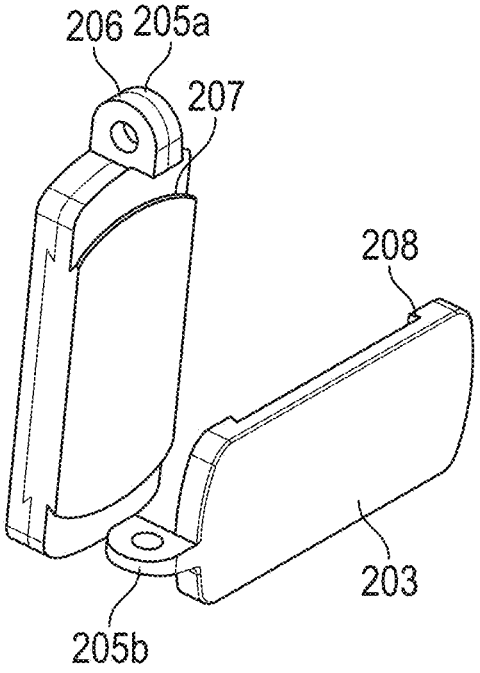
Figure 10:
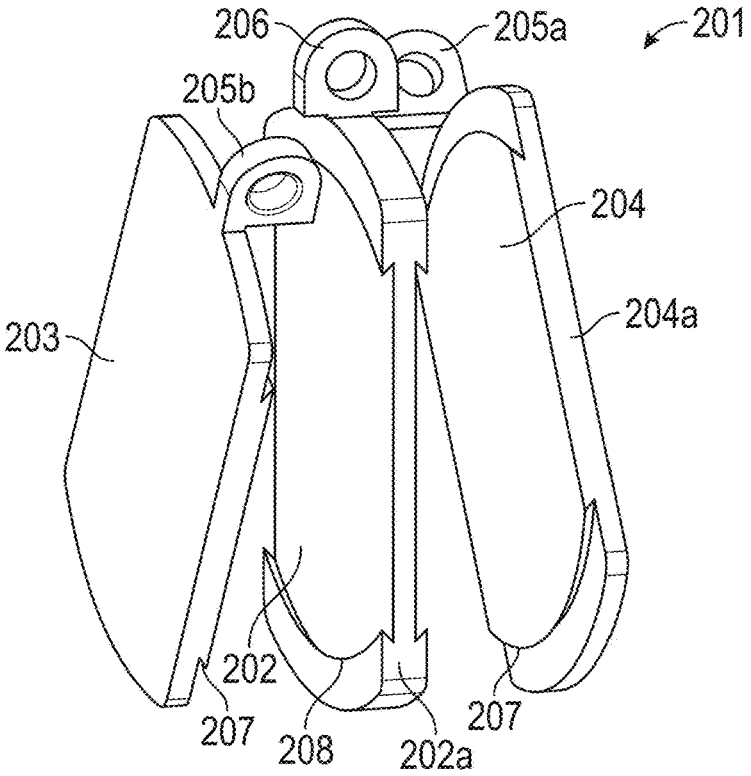
FIG. 10 is an exploded view of a rectangular pendant illustrating: each plate member; a hanging loop component, or portion, on each plate member; an interlocking attachment mechanism for the plate members; each of the outer plate members rotated 15°, in opposites directions, from the central plate member, disengaged, and pulled away, from the central plate member to expose two additional surfaces, in addition to all the original surfaces shown in FIG. 10, for capturing and displaying information or images.

FIG. 4A-B shows the integral hanging loop component, or portion, of the central plate member 106 for a round pendant device. The integral hanging loop component, or portion, of the central plate member 106 also acts as a stop, limiting the rotational travel for the hanging loop components, or portions, of outer plate members 105*a* and 105*b*, when outer plate members 103 and 104 are rotated to manipulate the device from the closed viewing position to an open viewing position. The rotation exposes an inside surface of the central plate member 102 and the back side surface of the outer plate members 103 and 104. Similarly, FIG. 8A-B shows the integral hanging loop component, or portion, of the central plate member 206 for a rectangular pendant device which also acts as a stop, limiting the rotational travel for the hanging loop components, or portions, of each outer plate member 205*a* and 205*b*, when the outer plate members 203 is rotated to manipulate the device, from the closed viewing position to an open viewing position, to expose additional surfaces of the device. In this particular embodiment, the inside surface of the central plate member 202 and the back side surface of the outer plate member 203 are exposed. FIG. 10 shows the integral hanging loop portion of the central plate member 206 for a rectangular pendant device, which acts as a stop, limiting the rotational travel for the hanging loop components, or portions, of each outer plate member 205*a* and 205*b*, when both outer plate members 203 and 204 are rotated to manipulate the device from the closed viewing position to an open viewing position. The rotation exposes additional surfaces of the device. In this particular embodiment, the two inside surfaces of the central plate member 202, and the inside surfaces of outer plate members 203 and 203, are exposed providing expanded viewing surfaces for capturing and displaying information and images.

FIG. 3 and FIG. 4A-B also illustrate the interlocking attachment mechanism for the central plate member 106 and outer plate members 103 and 104. The interlocking attachment mechanism, used to securely attach the plates, is fully contained within the assembled device 101. The operational parts for the mechanism include, for example, rails 107 and channels, or receiving depressions for the rails 108, which are positioned in various places on the surface of a central plate member 102 or the outer plate members 103 and 104. The central plate member 102 and outer plate members 103 and 104 can either comprise rails 107 or channels 108, so long as the plate members don't both comprise rails 107 or channels 108. The location of the rails 107 and channels 108 on a plate member is dependent, for example, on the information, images or shape of the plate member. The rails 107 and channels 108 can be geometric specific, depending on the shape of the plate members, and as many as may be needed can be used to engage and adequately hold and secure the facially opposing plate members so that they are engaged in a substantially flush, and secure, manner in and around the area of the interlocking attachment mechanism.

In FIG. 3 and FIG. 4A-B, the rails 107 sit along the inner circumference of the central plate member 102 and the channels 108 sit along the inner surface of the outer plate members 103 and 104. The rails 107 on a plate member are positioned, aligned, or manipulated so that the rails 107 can be inserted or slid into the channels 108 on the surface of the opposite facing, or facially opposing, plate members.

FIG. 6A-D illustrates a round device of the invention, in an open viewing position, where multiple rail segments 107 sit along the surface of the central plate member 102 and multiple channel segments 108 sit along the inner surface of the outer plate member 104. FIG. 6A-D also shows a sequence for the rails 107 and channels 108 of a central plate member 102 being fully engaged, then being partially disengaged after being rotated 15°, and being completely disengaged after being rotated 30°. FIG. 7A-C illustrates a rectangular device embodiment of the invention, in a closed viewing position, where the channels 208 sit along the periphery of the surface on both sides of the central plate member 202 and extend along approximately the full periphery of the central plate member 202. The rails 207 also extend along approximately the full periphery of the outer plate members 203 and 204. Notwithstanding the shape, or configuration, of the device, in every embodiment of the invention, the outer plate members 103, 104, 203 and 204 are displaced, or rotated, approximately 15° to 90°, to disengage them from the central plate member 102 and 202.

FIGS. 8A-B and FIG. 9A-B each represent a jewelry device in the closed and partially closed viewing position, respectively having two plate members, being a central plate member 202 and outer plate member 203 that are rotated, with respect to each other, in either a clockwise or counterclockwise direction. The degree of rotation will vary depending on the co-extensive length of the rails 207 and the channels 208. In these particular embodiments, the degree of rotation is 45° and 90°, respectively. The rotational travel causes the rails 207 to slide into the channels 208 and generate a substantially flush contact between the central plate member 202 and the outer plate member 203. As described above, the rails 107 are manipulated to move along, or rotate around, a central axis common to the plate members being engaged with each other and secured into position. The rails 107 and the channels 108 together produce an interlocking attachment mechanism, which holds the plate members together and allows them to connect, or attach, securely to each other in a substantially flush manner, and along the co-extensive lengths of the rails 107 and channels 108.

Figure 11:
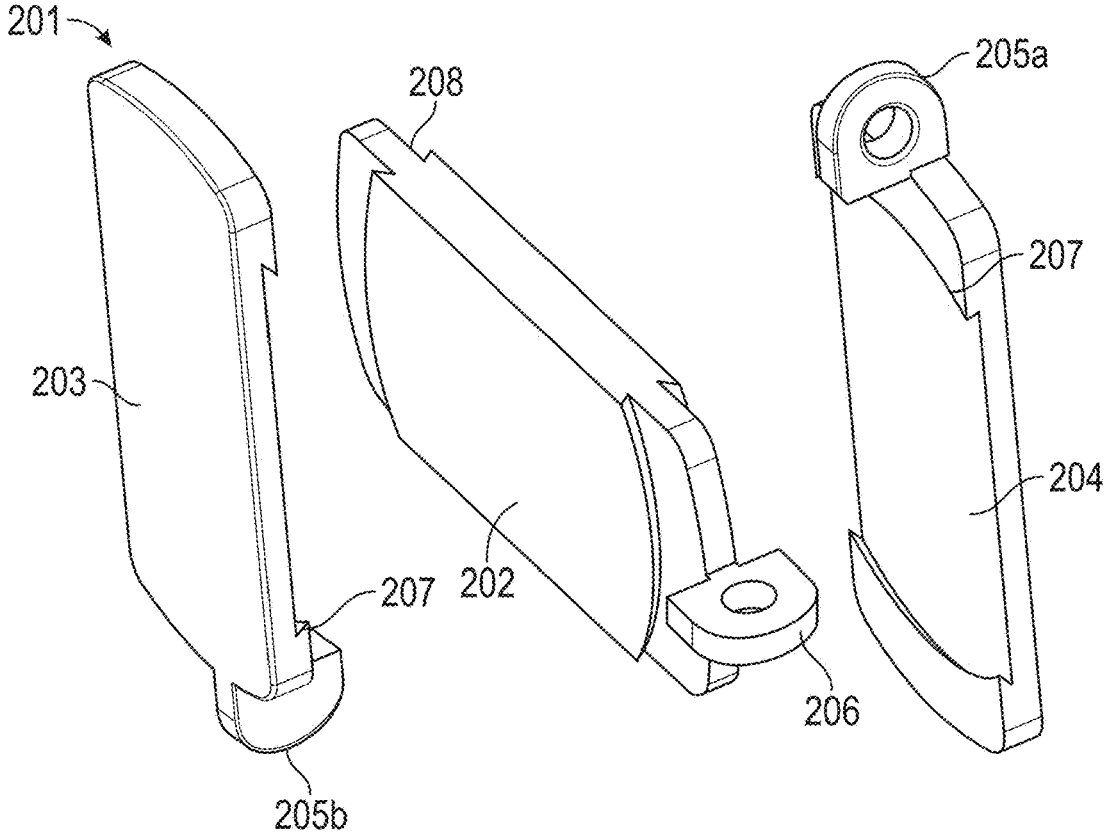
FIG. 11 is an exploded view of a rectangular pendant illustrating: three facially opposing plate members; a hanging loop component, or portion, on each plate member; an interlocking attachment mechanism for the plate members; outer plate members rotated 90°, in opposites directions, from the central plate member, disengaged, and pulled away, from the central plate member to expose two additional surfaces, in addition to all the original surfaces shown in FIG. 11, for capturing and displaying information or images.

FIG. 10 and FIG. 11 represent a rectangular jewelry device in an open viewing position, having three fully disengaged plate members, being a central plate member 202 and two outer plate members 203 and 204. The plate members are rotated, with respect to each other, in either a clockwise or counterclockwise direction. Again, the degree of rotation will vary depending on the co-extensive length of the rails 207 and the channels 208. In these two particular embodiments, the degree of rotation is 15° and 90°, respectively.

To open the device and disengage the facially opposing plate members, as shown in FIG. 8A-B, FIG. 9A-B, FIG. 10 and FIG. 11, sufficient force must be applied, for example by hand, to either the central plate members 102 and 202 and/or the outer plate members 103, 104, 203 and 204 to rotate the plate members and thereby move or slide the rails 107 out of the channels 108. The outer plate members 103, 104, 203 and 204 are then pulled away and disengaged from the central plate members 102 and 202. The disengagement of the plate members exposes additional or expanded surfaces on the device for capturing and displaying information or images.

FIG. 12A-C shows two facially opposing plate members on the jewelry device 301 having two integral hanging loops 306, and offering four initial surfaces 303, 303*a*, 302 and 302*a* for capturing and displaying information or images. The device is comprised of a front plate member 303 and a back plate member 302, where the back plate member is comprised of a cavity. The plate members 303 and 302 are rotated, with respect to each other, in either a clockwise or counterclockwise direction. The degree of rotation will vary depending on the co-extensive length of the rails on the back plate member 302 and the channels on the front plate member 303. In this particular embodiment of the invention, the front plate member 303 is rotated 90° from the back plate member 302. The front plate member 303 is then disengaged and completely pulled away from the back plate member 302. The disengagement of the plate members exposes five additional inner surfaces on the back plate member 302, and one additional surface on the inside of the front plate member 303, in addition to all the original surfaces for capturing and displaying information or images.

Figure 13A:
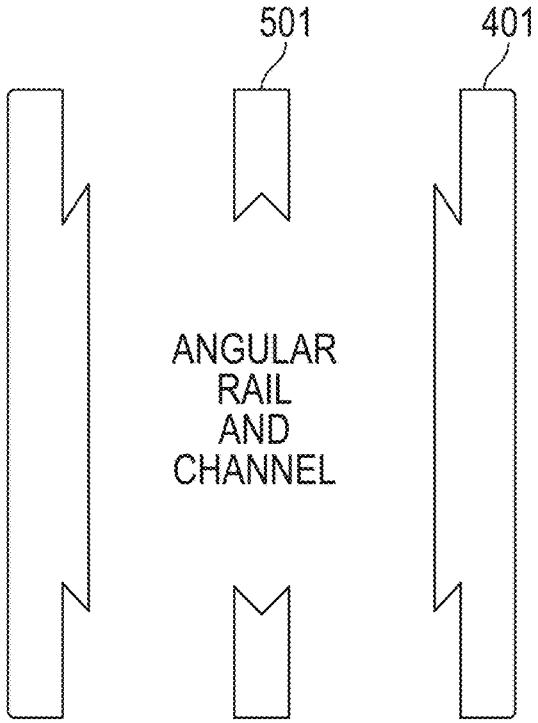
FIGS. 13A. 13B, and 13C, illustrate a magnified view of three different geometric designs for the rails and channels used to form, and create, an interlocking attachment mechanism on the surfaces of the facially opposing plate members.
Figure 13B:
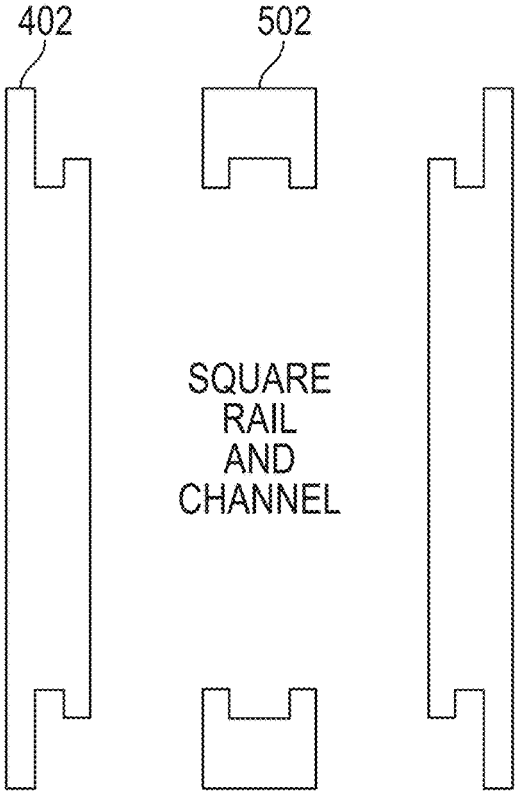
Figure 13C:
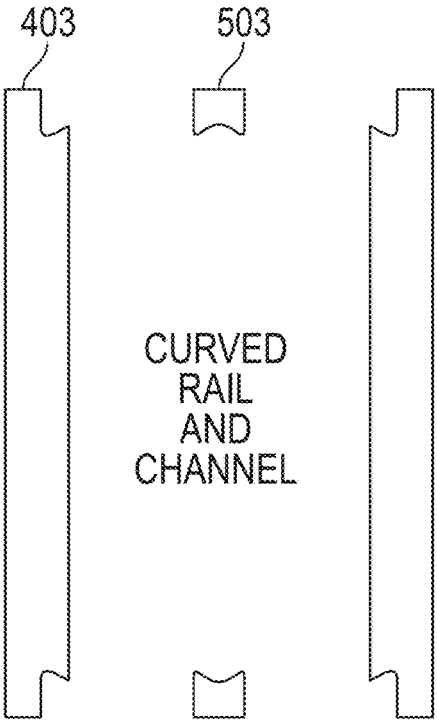
Figure 14A:
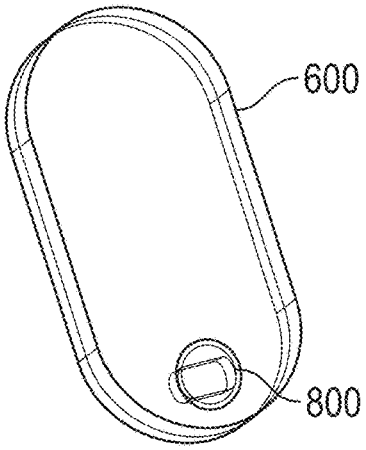
FIGS. 14A. 14B. 14C. 14D, and 14E show, a perspective view of two oval, and one rectangular, pendant illustrating: facially opposing plate members; hanging loops and hanging loop components, or portions, on the oval and rectangular plate members; and three different interlocking attachment mechanisms for the plate members, represented by a button, hook or latch used for detaching the plate members, when the plate members are rotated, individually or together, either in an opposite or counterclockwise direction, to disengage, and pull apart the plate members, to expose additional surfaces, in addition to all the original surfaces shown in FIGS. 14A, 14B, 14C, 14D, and 14E, for capturing and displaying information or images.
Figure 14B:
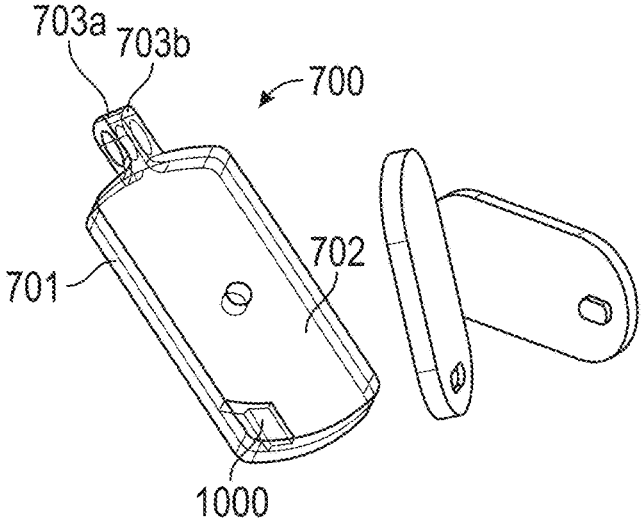
Figure 14C:
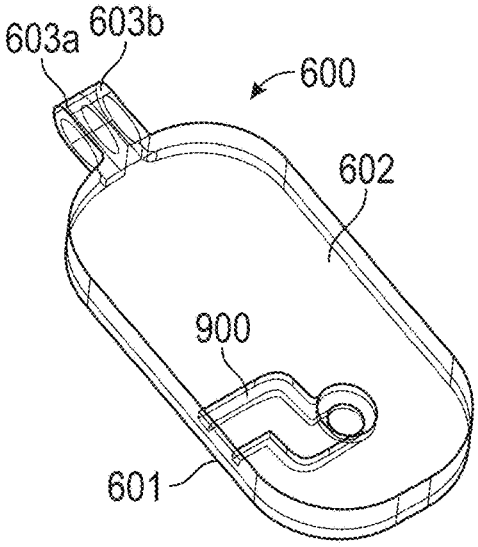
Figure 14D:
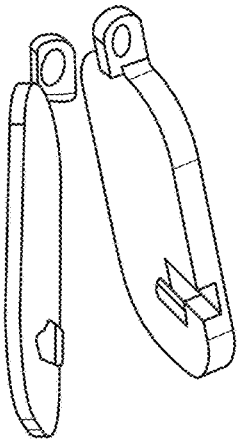
Figure 14E:
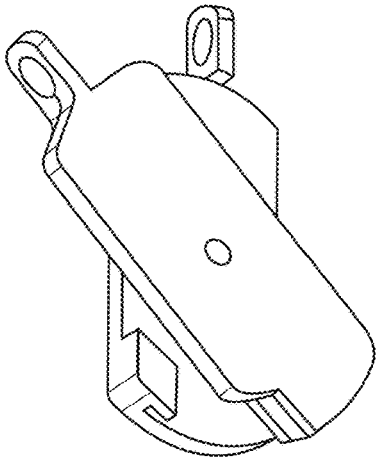

FIG. 13A-C is a magnified view of three different exemplary geometric designs for the rails 401 (angular rail design), 402 (square rail design) and 403 (curved rail design) and channels 501 (angular channel design), 502 (square channel design), and 503 (curved channel design) that may be used to form, and create, the interlocking attachment mechanism on the surfaces of the facially opposing plate members.

FIG. 14A-E represents an oval pendant jewelry device 600 and a rectangular pendant jewelry device 700 comprised of facially opposing plate members 601, 602, 701, and 702 and integral hanging loop components, or portions 603*a*, 603*b*, 703*a*, and 703*b* which act as stops to limit the rotational travel when the facially opposing plate members 601, 602, 701, and 702 are rotated to manipulate the jewelry device from a closed viewing position to an open viewing position. Also shown are three different interlocking attachment mechanisms for the plate members, represented by a button interlocking attachment mechanism 800, a hook interlocking attachment mechanism 900, and a latch interlocking attachment mechanism 1000 used to detach the plate members. To activate the detachment, one or both plate members are rotated in an opposite clockwise or counterclockwise direction, allowing the plate members to become disengaged and pulled apart, exposing expanded or additional surfaces for capturing and displaying information or images, in addition to the original surfaces shown in FIG. 14A-E, for capturing and displaying information or images.

It is to be understood that there are variations available to the embodiments shown in FIG. 1 to FIG. 14. Such variations may include, but are not limited to, the size and shape of the jewelry device, the number of loops, the designs on the surfaces of the central and outer plate members. The variability of the design is rather large since the plate members of the device can be configured to have different lengths, sizes and shapes at the discretion of the designer and manufacturer of the device. It is helpful that the plate members can be configured in a very simple manner where the device can be in an open or closed viewing position and replaced with new plate members any time so that the design can be changed at will. The decorative aspect of the device is well suited for arts and crafts and promotes a do-it-yourself construction that would appeal to all age groups. The device is also suitable for arts and crafts applications in assisted living facilities.

Although the present invention has been described with reference to preferred embodiments, those skilled in the art will recognize that changes, revisions and various modifications may be made in form, construction, and detail, to the extent foreseeable, without departing from the spirit and scope of the invention. However, all such changes, revisions and modifications that are evident to those skilled in the art will be included with in the scope of the invention as described herein. It should be understood that the preferred embodiments are described to provide the best illustration of the principles of the invention and its practical application to thereby enable one of ordinary skill in the art to utilize the invention in various embodiments, and with various modifications, as are suited to the particular use contemplated.

What is claimed:

1. A jewelry device comprising a plurality of plate members, each plate member comprising:

at least one facial surface that is capable of abutting the at least one facial surface of an adjacent plate member, when the plurality of plate members are attachable;

a circumference of the at least one facial surface; and an integral hanging loop component extending from the circumference, having a surface positioned to be perpendicular to the at least one facial surface, the surface of each hanging loop component is capable of abutting the surface of another integral hanging loop component to form an integral loop when the plurality of facially opposing plate members are attached, and at least one of an ornamental design, information, or image, located on the abutting facial surfaces of the at least one plate member; and an interlocking attachment mechanism, fully contained within the jewelry device, wherein the interlocking attachment mechanism attaches or detaches the plate members in a substantially flush manner, wherein the interlocking attachment mechanism is comprised of rails and channels along the facial surface of the plate members.

2. The jewelry device of claim 1, wherein when the plurality of plate members are attached with respect to each other, the plurality of facial surfaces are abutting and cannot display the at least one of an ornamental design, information, or image.

3. The jewelry device of claim 1, wherein when the plurality of plate members are detached with respect to each other, the plurality of facial surfaces are exposed to display the at least one of an ornamental design, information, or image.

4. The jewelry device of claim 1, wherein the circumferences of the plurality of plate members conform in orientation, configuration, or shape, to one another.

5. The jewelry device of claim 1, wherein each integral hanging loop component is configured to limit the rotation of the facially opposing plate members relative to each other.

* * * * *